United States Patent [19]

Roberts et al.

[11] Patent Number: 4,863,515

[45] Date of Patent: Sep. 5, 1989

[54] TOOL STEEL

[75] Inventors: William Roberts; Börje Johansson, both of Hagfors, Sweden

[73] Assignee: Uddeholm Tooling Aktiebolag, Hagfors, Sweden

[21] Appl. No.: 133,794

[22] Filed: Dec. 16, 1987

[30] Foreign Application Priority Data

Dec. 30, 1986 [SE] Sweden ..... 8605597

[51] Int. Cl.[4] ..... C22C 29/04

[52] U.S. Cl. ..... 75/238; 75/239; 75/241; 75/246

[58] Field of Search ..... 75/238, 239, 241, 246

[56] References Cited

U.S. PATENT DOCUMENTS

| | | | |
|---|---|---|---|
| 4,121,917 | 1/1978 | Lohman et al. | 419/14 |
| 4,121,929 | 10/1978 | Kawai et al. | 75/238 |
| 4,121,930 | 10/1978 | Yukawa et al. | 75/238 |
| 4,249,945 | 2/1981 | Haswell et al. | 75/241 |
| 4,345,942 | 8/1982 | Takahashi et al. | 75/237 |
| 4,345,943 | 8/1982 | Takahashi et al. | 75/238 |
| 4,348,232 | 9/1982 | Hiraoka et al. | 75/238 |
| 4,664,706 | 5/1987 | Drozda | 75/246 |
| 4,724,000 | 2/1988 | Larson et al. | 75/236 |

FOREIGN PATENT DOCUMENTS

| | | | |
|---|---|---|---|
| 3017310 | 11/1980 | Fed. Rep. of Germany | 75/241 |
| 3444714 | 6/1986 | Fed. Rep. of Germany | 75/239 |
| 3444715 | 6/1986 | Fed. Rep. of Germany | 75/239 |
| 58-126963 | 7/1983 | Japan | 75/241 |
| 58-130259 | 8/1983 | Japan | 75/241 |
| 59-64748 | 12/1984 | Japan . | |
| 61-139645 | 6/1986 | Japan | 75/241 |
| 648646 | 2/1979 | U.S.S.R. . | |

*Primary Examiner*—Stephen J. Lechert, Jr.
*Attorney, Agent, or Firm*—Armstrong, Nikaido, Marmelstein, Kubovcik & Murray

[57] ABSTRACT

The invention relates to a tool steel intended for cold working operations and having very high impact strength and good resistance to wear, said steel being made powder-metallurgically by consolidation of metal powder to a dense body. The steel has the following chemical composition expessed in weight-% 1–2.5% C, 0.1–2% Si, max 0.3% N, 0.1–2% Mn, 6.5–11% Cr, max 4% Mo, max 1% W and 3–7% V, wherein up to half the amount of vanadium can be replaced by 1.5 times as much niobium, and wherein the ratio V/C shall amount to between 2.5 and 3.7, balance essentially only iron and impurities and accessory elements in normal amounts.

17 Claims, 2 Drawing Sheets

TOOL STEEL

DESCRIPTION

TECHNICAL FIELD

This invention relates to a tool steel intended for cold working, in the first place for cutting and punching metallic materials but also for plastically forming, cold working operations, as for example for deep-drawing tools and for cold-rolling rollers. The steel is manufactured utilizing powder-metallurgy by consolidating metal powder to a dense body. It is characterised by a very high impact strength in combination with good wear resistance.

BACKGROUND OF THE INVENTION

Tool materials for cutting, punching or forming metallic materials as well as tool materials which are subject to impact and/or heavy wear shall fulfil a number of demands which are difficult to combine. The tool material thus must be tough as well as wear resistant. Particularly high demands are raised upon the impact strength, when the tool is intended for cutting or punching comparatively thick metal plates or the like. Further the tool material must not be too expensive, which limits the possibility of choosing high contents of expensive alloying components.

Conventionally so called cold work steels are used in this technical field. These steels have a high content of carbon and a high content of chromium and consequently good wear resistance, hardenability and tempering resistance. On the other hand, the impact strength of these steels are not sufficient for all fields of application. This particularly concerns the impact strength in the transversal direction and this at least to some degree is due to the conventional manufacturing technique. Powder-metallurgically produced steels offer better features as far as the impact strength is concerned. By way of example metallurgically manufactured high speed steels have been used, which steels also have a comparatively good wear resistance. In spite of the improvements with reference to the impact strength which has been achieved through the powder-metallurgical manufacturing technique, it is desirable to offer still better tool materials in this respect and at the same time to maintain or if possible further improve other important features of the material, particularly the wear strength. Furthermore it is desirable to keep the alloying costs low by not using such expensive alloying elements as tungsten and/or cobalt, which normally are present in high amounts in high speed steels.

BRIEF DISCLOSURE OF THE INVENTION

With reference to the above mentioned background it is an object of the invention to offer a new, powder-metallurgically produced cold worked steel with very high toughness, good wear resistance, high tempering resistance and good machinability and polishability, which features of the material shall be combined with moderate costs for the alloying elements which are present in the material.

In order to satisfy this combination of requirements, the steel shall according to the invention contain in weight-% 1–2.5% C, 0.1–2% Si, max 0.3% N, 0.1–2% Mn, 6.5–11% Cr, max 4% Mo, max 1% W and 3–7% V, wherein up to half the amount of vanadium can be replaced by 1.5 times as much niobium, and wherein the ratio V/C shall amount to between 2.5 and 3.7. Besides these elements the steel shall contain essentially only iron and impurities and accessory elements in normal quantities. Slightly less than half the carbon content can be found as vanadium carbides, particularly $V_4C_3$ carbides. The total carbide content amounts to between 5 and 20 volume-%, preferably between 5 and 12 volume-%, the carbon which is not bound in the form of carbides or other hard compounds, about 0.5–1% C, being dissolved in the steel matrix.

The preferred contents of the alloying elements existing in the steel are apparent from the appending claims. Further characteristic features and aspects on the steel of the invention will be apparent from the following description of manufactured and tested materials.

BRIEF DESCRIPTION OF THE DRAWINGS

In the following description reference will be made to the attached drawings, in which FIG. 1 in the form of bar charts illustrates the impact strength of tested materials, FIG. 2 in the form of bar charts illustrates the wear resistance expressed as rate of wear of tested materials, FIG. 3 in the form of a diagram illustrates the wear of punches made of tested materials as a function of the number of cutting operations in the case of punching stainless steel (adhesive wearing conditions), and FIG. 4 in a corresponding mode illustrates the wearing of the punch in the case of punching high strength steel strips (abrasive wearing conditions).

DESCRIPTION OF PREFERRED EMBODIMENTS AND PERFORMED TESTS

The chemical compositions of those steels which were examined are apparent from Table 1. All the indicated contents refer to weight-%. Besides those elements which are mentioned in the table, the steel also contained impurities and accessory elements in normal amounts, balance iron.

TABLE 1

| Steel No. | C | Si | Mn | Cr | Mo | V | W | Co | V/C | V/Mo |
|---|---|---|---|---|---|---|---|---|---|---|
| 1 | 1.24 | 1.00 | 0.42 | 7.90 | 1.54 | 4.07 | — | — | 3.3 | 2.6 |
| 2 | 1.93 | 0.94 | 0.44 | 8.30 | 1.50 | 6.20 | — | — | 3.2 | 4.1 |
| 3 | 2.93 | 0.95 | 0.49 | 8.40 | 1.50 | 10.3 | — | — | 3.5 | 6.9 |
| 4 | 1.28 | 0.5 | 0.3 | 4.2 | 5.0 | 3.1 | 6.4 | — | 2.8 | 0.6 |
| 5 | 2.3 | 0.4 | 0.3 | 4.2 | 7.0 | 6.5 | 6.5 | 10.5 | 2.8 | 0.9 |
| 6 | 1.55 | 0.3 | 0.3 | 12.0 | 0.8 | 0.8 | — | — | .07 | 1.0 |
| 7 | 1.27 | 0.93 | 0.41 | 8.1 | 1.56 | 4.4 | — | — | 3.5 | 2.8 |
| 8 | 1.43 | 1.00 | 0.36 | 7.97 | 1.51 | 4.33 | — | — | 3.0 | 2.8 |
| 9 | 1.49 | 0.96 | 0.37 | 8.17 | 1.56 | 4.39 | | | 2.9 | 2.8 |

Steels Nos. 1–3 and 7–9 were made from gas atomized steel powder, which was consolidated in a manner known per se through hot isostatic pressing to full density. Steels Nos. 4, 5 and 6 consisted of commercially available reference materials. More particularly steels Nos. 4 and 5 consisted of powder-metallurgically manufactured high speed steel, while steel No. 6 was a conventionally manufactured cold work steel. The compositions indicated for steels Nos. 1–3 and Nos. 7–9 were analysed compositions, while the compositions for the reference materials Nos. 4, 5 and 6 are nominal compositions.

The three compacted billets of steels Nos. 1, 2 and 3 were forged to appr 80×40 mm, while the compated billets of steels Nos. 7, 8 and 9 were forged to the dimensions 100 mm ϕ, 180×180 mm, and 172 mm ϕ, respectively. For the examination of the test materials, including the reference materials Nos. 4, 5 and 6, there were made test specimens 7×10×55 mm without any notches. The test specimens were hardened by austenitizing and cooling in air from the austenitizing temperature, whereafter the specimens were tempered. The austenitizing and tempering temperatures and the hardness after tempering are given in Table 2:

TABLE 2

| Steel No. | Austenitizing temperature (°C.) | Tempering temperature (°C.) | Hardness (HRC) |
|---|---|---|---|
| 1 | 1070 | 200 | 61 |
| 2 | 1050 | 200 | 62 |
| 3 | 1020 | 200 | 62 |
| 4 | 1150 | 570 | 61 |
| 5 | 1100 | 620 | 62 |
| 6 | 1020 | 200 | 62 |
| 7 | 1070 | 200 (1 h) | 61 |
| 8 | 1050 | 200 (2 h) | 60 |
| 9 | 1035 | 200 (2 h) | 60 |

Figure 1:
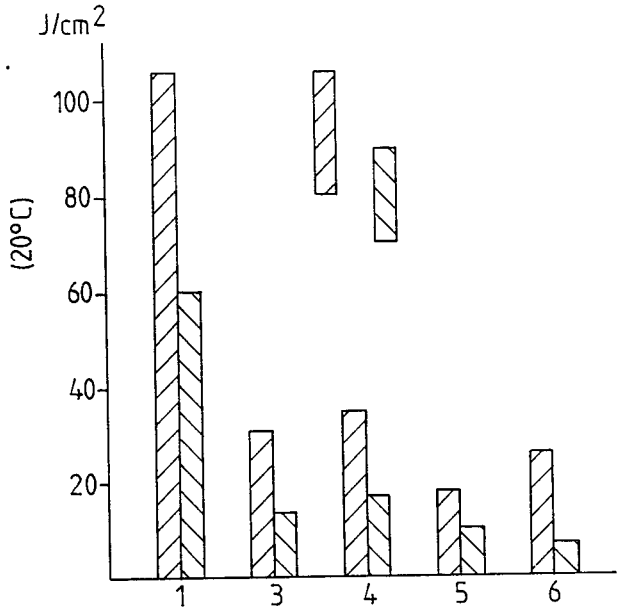

The impact strength expressed as absorbed energy was measured in the longitudinal as well as the transversal direction of the test specimens at 20° C. The results achieved for steels Nos. 1–6 are apparent from FIG. 1. As shown in the diagram steel No. 1 had the by far best toughness of these steels expressed as absorbed energy in the longitudinal as well as the transverse direction. Steel No. 3 had an impact strength which was comparable with that of the comparatively low alloyed, powder-metallurgically manufactured high speed steel No. 4. Steels Nos. 5 and 6 had not as good impact strength, particularly not in the transverse direction. At the examination of steels Nos. 7, 8 and 9 the following impact strengths in the longitudinal direction were measured: 106; 103; and 111 joule/cm$^2$, respectively. These steels in other words had an impact strength in the same order as that of steel No. 1.

The wear resistance of steels Nos. 1–6 were determined in terms of the rate of abrasive wear against wet SiC-paper (180 #) which had a speed of 250 rmp at a contact pressure of 0.1N/mm$^2$. The paper was replaced every 30 second.

Figure 2:
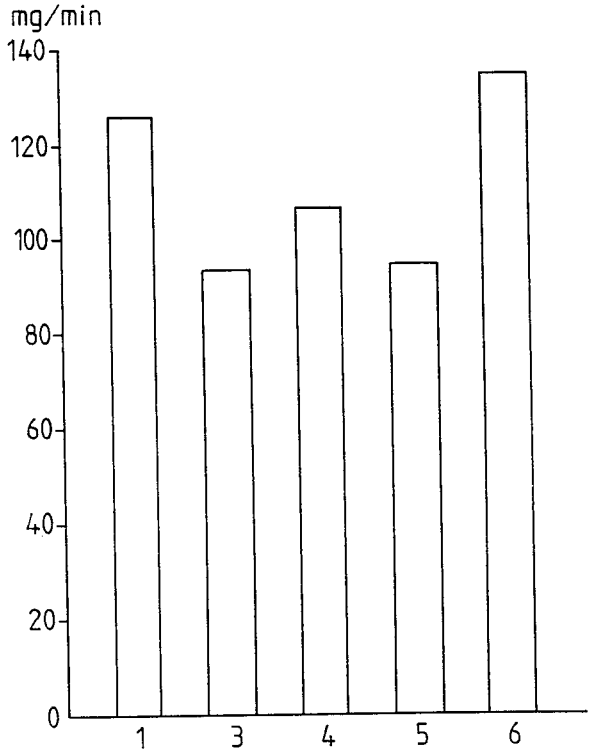
Figure 3:
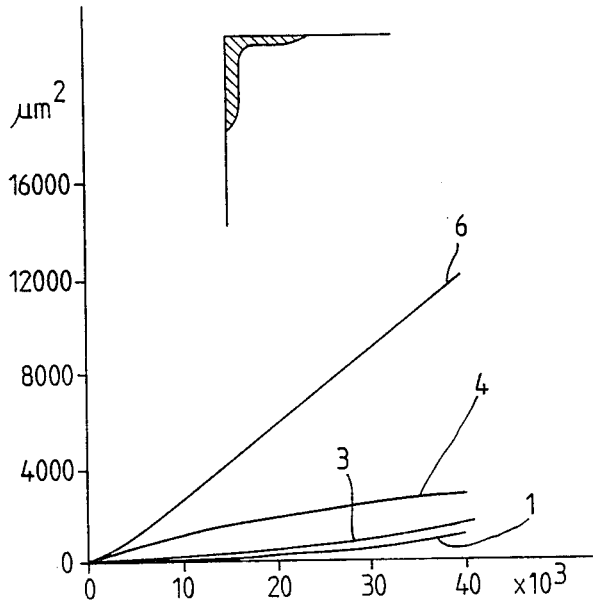

The result of the measurements of the abrasion wear against the SiC-paper is illustrated in FIG. 2. The lowest abrasion rate, i.e. the best values, was achieved by steel No. 3, closely followed by the high alloyed high speed steel No. 5. Steel No. 1 had somewhat lower values, however better than the abrasion wear resistance of the conventional cold work steel No. 6.

Figure 4:
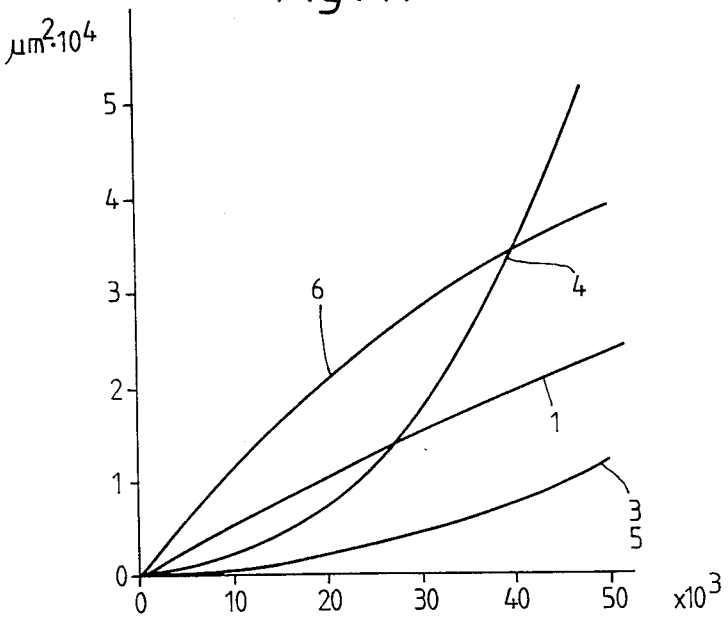

Thereafter the resistance to wear of steels Nos. 1–6 was measured in terms of wear of a punch as a function of number of cutting operations in stainless steel of type 18/8, i.e. under adhesive wear conditions. The results are illustrated in FIG. 4. This figure also shows a typical appearance of a defect caused by wear on a tool manufactured of the various materials. The lowest wear was obtained with steel No. 3, and also steel No. 1 had a very high resistance against this type of wear. The comparatively low alloyed high speed steel No. 4 and particularly the cold work steel No. 6 had by far more disadvantageous values.

Finally also the wear of punches manufactured of the tested materials Nos. 1–6 was tested under abrasive wear conditions. The punching operations this time were performed in high strength steel strips. Under these conditions the more high alloyed steels Nos. 3 and 5 had the best values. Steel No. 1 was not as good under these abrasive wear conditions, however by far better than the cold work steel No. 6. The high speed steel No. 4 had quite a different picture as far as the wear is concerned. Initially the resistance to wear was good but gradually the wear turned out to accelerate.

To sum up, steels Nos. 1, 7, 8 and 9 were demonstrated to have superiously good impact strength. Steel No. 1 at the same time had a resistance to wear which was by far better than that of high alloyed cold work steel and comparable with that of high quality, powder-metallurgically manufactured high speed steels. A steel of type No. 1, in which type also are included steels Nos. 7, 8 and 9 which have a similar alloy composition, therefore should be useful for cold working applications where particularly high demands are raised upon the impact strength, while steel of type No. 3 may be chosen when it is the resistance to wear rather than the impact strength that is the critical feature of the steel.

We claim:

1. A tool steel intended for cold working operations and having very high impact strength and good resistance to wear, said steel being made powder-metallurgically by consolidation of metal powder to a dense body, characterized in that it has the following chemical composition expressed in weight-% 1–2.5% C, 0.1–2% Si, max 0.3% N, 0.1–2% Mn, 6.5–11% Cr, max 4% Mo, max 1% W and 3–7% V, wherein up to half the amount of vanadium can be replaced by 1.5 times as much niobium, the maximum V/C ratio being 3.7, and the ratio V/Mo being at least 2.6, the balance being essentially only iron and impurities and accessory elements in normal amounts.

2. A tool steel according to claim 1, characterised in that it contains 3–5% V.

3. A tool steel according to claim 2, characterised in that it contains 1–1.5% C.

4. A tool steel according to claim 2, characterised in that it contains 1.2–1.8% C.

5. A tool steel according to claim 4, characterised in that it contains about 4% V and about 1.5% C.

6. A tool steel according to claim 4, characterised in that the ratio V/C=2.8–3.7.

7. A tool steel according to claim 6, characterised in that the ratio V/C=3.0–3.5.

8. A tool steel according to claim 1, characterised in that it contains 5–7% V.

9. A tool steel according to claim 8, characterised in that it contains 1.5–2.3% C.

10. A tool steel according to any one of claims 2–9 or 1, characterised in that it contains 7–10% Cr and 0.5–3% Mo.

11. A tool steel according to claim 10, characterised in that it contains 1–2% Mo.

12. A tool steel according to claim 11, characterised in that it does not contain more than incidental impurity contents of W.

13. A tool steel according to claim 12, characterised in that it contains 0.2–0.9% Mn.

14. A tool steel according to claim 13, characterised in that it contains 0.5–1.5% Si.

15. A tool steel according to claim 14, characterised in that the total carbon content, where the main part of the carbides consists of carbides of MC-type, amounts to between 5 and 20 volume-%.

16. A tool steel according to claim 1, wherein the V/Mo ratio is in the range of 2.6 to 6.9.

17. A tool steel according to claim 15 wherein said carbides are present in amounts of between 5 and 12 volume %.

* * * * *